US010188142B2

(12) United States Patent
Fournier et al.

(10) Patent No.: US 10,188,142 B2
(45) Date of Patent: Jan. 29, 2019

(54) AMPHIPHILE-MODIFIED SORBENTS IN SMOKING ARTICLES AND FILTERS

(71) Applicant: Philip Morris USA Inc., Richmond, VA (US)

(72) Inventors: Jay A. Fournier, Richmond, VA (US); Luan Zhaohua, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 601 days.

(21) Appl. No.: 14/982,875

(22) Filed: Dec. 29, 2015

(65) Prior Publication Data

US 2016/0128380 A1 May 12, 2016

Related U.S. Application Data

(62) Division of application No. 12/896,463, filed on Oct. 1, 2010, now Pat. No. 9,232,821, which is a division of application No. 10/740,510, filed on Dec. 22, 2003, now Pat. No. 7,827,996.

(51) Int. Cl.

| | |
|---|---|
| ***A24D 3/12*** | (2006.01) |
| ***A24D 3/14*** | (2006.01) |
| ***A24D 3/16*** | (2006.01) |
| ***A24D 3/06*** | (2006.01) |
| ***A24D 3/08*** | (2006.01) |
| ***A24D 3/10*** | (2006.01) |

(52) U.S. Cl.

CPC ..... *A24D 3/12* (2013.01); *A24D 3/062* (2013.01); *A24D 3/067* (2013.01); *A24D 3/08* (2013.01); *A24D 3/10* (2013.01); *A24D 3/14* (2013.01); *A24D 3/166* (2013.01)

(58) Field of Classification Search

None

See application file for complete search history.

(56) References Cited

U.S. PATENT DOCUMENTS

| | | | |
|---|---|---|---|
| 2,695,618 | A | 11/1954 | Policansky |
| 2,882,243 | A | 4/1959 | Milton |
| 3,025,233 | A | 3/1962 | Figert |

(Continued)

FOREIGN PATENT DOCUMENTS

| | | |
|---|---|---|
| DE | 1038015 | 9/1958 |
| DE | 2917313 A | 11/1980 |

OTHER PUBLICATIONS

"Cationic Surfactant", http://www.orica.com.au/Business%5... CE75A4A2567D002000D6?OpenDocument, printed Aug. 7, 2001.

(Continued)

*Primary Examiner* — Michael J Felton

(74) *Attorney, Agent, or Firm* — Buchanan Ingersoll & Rooney LLC

(57) ABSTRACT

Smoking articles which involve the use of amphiphile-modified sorbents are disclosed. The amphiphile-modified sorbent has at least one amphiphilic compound bound to an inorganic molecular sieve substrate. The amphiphile-modified sorbent selectively removes certain constituents from cigarette smoke, while maintaining other constituents, such as those that contribute to flavor. Methods for making cigarette filters and smoking articles using amphiphile-modified sorbents, as well as methods for smoking a cigarette containing an amphiphile-modified sorbent, are also provided.

16 Claims, 3 Drawing Sheets

(56) References Cited

U.S. PATENT DOCUMENTS

| | | | |
|---|---|---|---|
| 3,055,654 | A | 9/1962 | Harrison et al. |
| 3,091,550 | A | 5/1963 | Doying |
| 3,130,007 | A | 4/1964 | Breck |
| 3,217,715 | A | 11/1965 | Berger et al. |
| 3,247,195 | A | 4/1966 | Kerr |
| 3,292,636 | A | 12/1966 | Mays |
| 3,308,069 | A | 3/1967 | Wadlinger et al. |
| 3,314,752 | A | 4/1967 | Kerr |
| 3,327,718 | A | 6/1967 | Kilburn |
| 3,572,348 | A | 3/1971 | Norman et al. |
| 3,652,461 | A | 3/1972 | Dalton |
| 3,702,886 | A | 11/1972 | Argauer et al. |
| 3,703,901 | A | 11/1972 | Norman et al. |
| 3,978,869 | A | 9/1976 | Uehara et al. |
| 4,022,223 | A | 5/1977 | Rainer et al. |
| 4,062,368 | A | 12/1977 | Crellin et al. |
| 4,148,864 | A | 4/1979 | Groth et al. |
| 4,177,822 | A | 12/1979 | Bryant, Jr. et al. |
| 4,236,533 | A | 12/1980 | De Clara |
| 4,246,009 | A | 1/1981 | Sawada et al. |
| 4,246,910 | A | 1/1981 | Rainer et al. |
| 4,252,687 | A | 2/1981 | Dale et al. |
| 4,256,609 | A | 3/1981 | Dale et al. |
| 4,317,460 | A | 3/1982 | Dale et al. |
| 4,364,403 | A | 12/1982 | Horsewell et al. |
| 4,397,321 | A | 8/1983 | Stuetz |
| 4,454,056 | A | 6/1984 | Kittelmann et al. |
| 4,604,110 | A | 8/1986 | Frazier |
| 4,662,384 | A | 5/1987 | Green |
| 4,964,426 | A | 10/1990 | Lee et al. |
| 4,982,000 | A | 1/1991 | Earl et al. |
| 5,060,672 | A | 10/1991 | Irimi et al. |
| 5,098,684 | A | 3/1992 | Kresge et al. |
| 5,102,643 | A | 4/1992 | Kresge et al. |
| 5,108,725 | A | 4/1992 | Beck et al. |
| 5,120,692 | A | 6/1992 | Beck |
| 5,149,435 | A | 9/1992 | Laube |
| 5,150,723 | A | 9/1992 | Lee et al. |
| 5,204,376 | A | 4/1993 | Henmi et al. |
| 5,212,131 | A | 5/1993 | Belding |
| 5,258,340 | A | 11/1993 | Augustine et al. |
| 5,261,948 | A | 11/1993 | Foley et al. |
| 5,278,112 | A | 1/1994 | Klatte |
| 5,360,023 | A | 11/1994 | Blakley et al. |
| 5,370,785 | A | 12/1994 | Beck et al. |
| 5,376,348 | A | 12/1994 | Stoilov et al. |
| 5,396,909 | A | 3/1995 | Gentry et al. |
| 5,404,890 | A | 4/1995 | Gentry et al. |
| 5,482,915 | A | 1/1996 | Golden et al. |
| 5,499,636 | A | 3/1996 | Baggett, Jr. et al. |
| 5,540,759 | A | 7/1996 | Golden et al. |
| 5,568,819 | A | 10/1996 | Gentry et al. |
| 5,657,772 | A | 8/1997 | Duke et al. |
| 5,666,976 | A | 9/1997 | Adams et al. |
| 5,692,525 | A | 12/1997 | Counts et al. |
| 5,692,526 | A | 12/1997 | Adams et al. |
| 5,705,269 | A | 1/1998 | Pimenov et al. |
| 5,727,573 | A | 3/1998 | Meier et al. |
| 5,738,793 | A | 4/1998 | Janks et al. |
| 5,833,739 | A | 11/1998 | Klatte et al. |
| 5,915,387 | A | 6/1999 | Baggett, Jr. et al. |
| 5,972,079 | A | 10/1999 | Foley et al. |
| 5,985,790 | A | 11/1999 | Moskovitz et al. |
| 5,988,176 | A | 11/1999 | Baggett, Jr. et al. |
| 6,026,820 | A | 2/2000 | Baggett, Jr. et al. |
| 6,074,974 | A | 6/2000 | Lee et al. |
| 6,117,810 | A | 9/2000 | Lee et al. |
| 6,119,699 | A | 9/2000 | Sung |
| 6,168,773 | B1 | 1/2001 | Sharp |
| 6,209,547 | B1 | 4/2001 | Koller et al. |
| 6,261,986 | B1 | 7/2001 | Bowman et al. |
| 6,584,979 | B2 | 7/2003 | Xue et al. |
| 6,596,909 | B2 | 7/2003 | Nishijima et al. |
| 2001/0012820 | A1 | 8/2001 | Nishijima et al. |
| 2004/0016436 | A1 | 1/2004 | Thomas |
| 2004/0194792 | A1 | 10/2004 | Zhuang et al. |
| 2005/0133047 | A1 | 6/2005 | Fournier et al. |
| 2005/0133051 | A1 | 6/2005 | Luan et al. |

OTHER PUBLICATIONS

"Surfactant-Modified Zeolite (SMZ)—A Versatile, Inexpensive Sorbent for Removing Contaminants from Water", http://www.ees.nmt.edu/Hydro/faculty/Bowman/Research/zeopage/smz.html, printed Jul. 31, 2001.

Zhaohui Li et al., Sorption of Ionizable Organic Solutes by Surfactant-Modified Zeolite, Enviroin. Sci. Technol. 2000, vol. 34, pp. 3756-3760.

Zhaohui Li et al., "Enhanced Reduction of Chromate and PCE by Pelletized Surfactant-Modified Zeolite/Zerovalent Iron", Environ. Sci. Technol. 1999, vol. 33, pp. 4326-4330.

Zhaohui Li et al., "Counterion Effects on the Sorption of Cationic Surfactant and Chromate on Natural Clinoptilolite", Environ. Sci. technol. 1997, vol. 31, pp. 2407-2412.

Gaydardjief S., et al., "Adsorption of Oxyanions with Surface Modified Zeolites", Acta Metallurgica Slovaca, 4, Special Issue Apr. 2001, pp. 51-57.

Robert S. Bowman, "Surfactant-Altered Zeolites as Permeable Barriers for In Situ Treatment of Contaminated Groundwater", Department of EArth and Environmental Sciences, New Mexico Tech.

Robert S. Bowman, "SMZ + Microorganisms for Combined Sorption/Biodegradation", http://www.ees.nmt.edu/bowman/research/SMZ/SMZBiodegrad.html, printed Aug. 12, 2002.

Robert S. Bowman, "SMZ/ZVI Permeable Barrier Pilot Test", http://www.ees.nmt.edu/bowman/research/SMZ/SMZZVIPilotTest.html, printed Aug. 12, 2002.

Robert S. Bowman, "SMZ for Removal of Pathogens from Sewage", http://www.ees.nmt.edu/bowman/research/SMZ/Pathogens.html, printed Aug. 12, 2002.

Robert S. Bowman, "SMZ/ZVI Pellets for Combined Sorption/Reduction", http://www.ees.nmt.edu/bowman/research/SMZ/SMZZVIProp.html, printed Aug. 12, 2002.

Robert S. Bowman, "SMZ for Treatment of Oil Field Wastewaters", http://www.ees.nmt.edu/bowman/research/SMZ/ProdWater.html, printed Aug. 12, 2002.

Robert S. Bowman, "SMZ Permeable Barrier Test Facility", http://www.ees.nmt.edu/bowman/research/SMZ/PilotTestFacility.html, printed Aug. 12, 2002.

Robert S. Bowman, "SMZ Permeable Barrier Test Results", http://www.ees.nmt.edu/bowman/research/SMZ/SMZPilotTest.html, printed Aug. 12, 2002.

Robert S. Bowman, Mechanisms of Surfactant and Contaminant Sorption by SMZ, http://www.ees.nmt.edu/bowman/research/SMZ/SMZSorpMech.html, printed Aug. 12, 2002.

Robert S. Bowman, "Zeolite-Surfactant Interactions", http://www.ees.nmt.edu/bowman/research/SMZ/ZeoSurfInt.html, printed Aug. 12, 2002.

Robert S. Bowman, "Surfactant-Modified-Zeolites (SMA) and their Applications to Environmental Remediation", http://www.ees.nmt.edu/bowman/research/SMZ/, printed Aug. 12, 2002.

Robert S. Bowman, "Properties of Zeolites", http://www.ees.nmt.edu/bowman/research/SMZ/ZeoProp.html, printed Aug. 12, 2002.

Robert S. Bowman, "Sorption of Anions, Cations, and Neutral Organics by SMA", http://www.ees.nmt.edu/bowman/research/SMZ/SMZSorp.html, printed Aug. 12, 2002.

March, "Advanced Organic Chemistry", (John Wiley & Sons Inc., 1995) (reference provided upon request).

House, "Modern Synthetic Reactions" (Benjamin Cummings, 1972) (reference provided upon request).

Robb, I.D., Ed., "Specialist Surfactants", Blackie Academic and Professional, First Edition, 1997, pp. 9-10.

Shiverick, K. T. et al., "Cigarette Smoking and Pregnancyl: Ovarian, Uterine and Placental Effects", Placenta, vol. 20, Issue 4, May 1999, pp. 265-272, ISSN 0143-4004, DOI: 10.1053/plac.1998.0377 (http://www.sciencedirect.com/science/article/B6WPD-45CRJY-1P/2/06f14dcd037185c4659fc1b92544b3).

AMPHIPHILE-MODIFIED SORBENTS IN SMOKING ARTICLES AND FILTERS

CROSS-REFERENCE TO RELATED APPLICATIONS

This application is a divisional application of U.S. application Ser. No. 12/896,463, filed on Oct. 1, 2010, which is a divisional application of U.S. application Ser. No. 10/740,510, filed on Dec. 22, 2003, the entire contents of each of which is hereby incorporated by reference.

BACKGROUND

Certain filter materials have been suggested for incorporation into cigarette filters, including cotton, paper, cellulose, and certain synthetic fibers. However, such filter materials generally only remove particulate and condensable components from tobacco smoke. Thus, they are usually not optimal for the removal of certain gaseous components from tobacco smoke, e.g., volatile organic compounds.

SUMMARY

Amphiphile-modified sorbents for removing one or more selected constituents from mainstream smoke are provided. In an embodiment, one or more constituents can be selectively removed from mainstream tobacco smoke, while retaining other constituents, such as those relating to flavor.

The selected constituent of mainstream smoke may be removed by the amphiphile-modified sorbent through molecular sieving, ion exchange, hydrophobic interactions, chelation, and/or chemical binding. Preferably, the selected constituent of mainstream smoke that is removed may be at least one of a hydrocarbon, polar organic and/or organic compound. Preferably, the selected constituent of mainstream smoke that is removed is an aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, and/or benzo(a)pyrene. More preferably, the constituent is an aldehyde.

In an embodiment, a smoking article is provided, which comprises an amphiphile-modified sorbent having at least one amphiphilic compound bound to an inorganic molecular sieve substrate. Examples of smoking articles include, but are not limited to a cigarette, a pipe, a cigar and a non-traditional cigarette. Preferably, the smoking article is a cigarette. Preferably, the smoking article is a cigarette including from about 50 mg to about 300 mg of the amphiphile-modified sorbent, more preferably from about 100 mg to about 200 mg of the amphiphile-modified sorbent. Preferably, the amphiphile-modified sorbent is located in a filter of the smoking article.

In yet another embodiment, a cigarette filter is provided, which comprises an amphiphile-modified sorbent having at least one amphiphilic compound bound to an inorganic molecular sieve substrate. Examples of filters include but are not limited to a mono filter; a dual filter, a triple filter, a cavity filter, a recessed filter or a free-flow filter. Preferably, the amphiphile-modified sorbent of the cigarette filter removes at least some of at least one selected constituent of mainstream smoke, more preferably removes at least some of a hydrocarbon or a polar organic compound constituent from mainstream smoke, and most preferably removes at least some of an aldehyde constituent from mainstream smoke.

The filter preferably comprises at least one material selected from the group consisting of cellulose acetate tow, cellulose paper, mono cellulose, mono acetate, and combinations thereof. In an embodiment, the amphiphile-modified sorbent is incorporated into one or more cigarette filter parts selected from the group consisting of shaped paper insert, a plug, a space, cigarette filter paper, and a free-flow sleeve.

Preferably, the amphiphile-modified sorbent is incorporated with cellulose acetate fibers forming a plug or a free-flow filter element, or incorporated with polypropylene fibers forming a plug or free-flow filter element. The amphiphile-modified sorbent may also be incorporated in at least one of a mouthpiece filter plug, a first tubular filter element adjacent to the mouthpiece filter plug, and a second tubular filter element adjacent to the first tubular element. In yet another embodiment, the amphiphile-modified sorbent is incorporated in at least one part of a three-piece filter including a mouthpiece filter plug, a first filter plug adjacent to the mouthpiece filter plug, and a second filter plug adjacent to the first filter plug.

In another embodiment, a method of making a cigarette filter is provided, which comprises incorporating an amphiphile-modified sorbent having at least one amphiphilic compound bound to an inorganic molecular sieve substrate into a cigarette filter.

In yet another embodiment, a method of making a cigarette is provided, which comprises: (i) providing a cut filler to a cigarette making machine to form a tobacco column; (ii) placing a paper wrapper around the tobacco column to form a tobacco rod; (iii) providing a cigarette filter comprising an amphiphile-modified sorbent having at least one amphiphilic compound bound to an inorganic molecular sieve substrate; and (iv) attaching the cigarette filter to the tobacco rod to form the cigarette.

In an embodiment, a method of smoking a cigarette is provided, which comprises lighting the cigarette to form smoke and drawing the smoke through the cigarette, wherein during the smoking of the cigarette, the amphiphile-modified sorbent removes one or more selected constituents from mainstream smoke.

Preferably, the amphiphilic compound may be covalently bound to the surface of the molecular sieve, or electrostatically bound to the surface of the molecular sieve.

Preferably, the amphiphile-modified sorbent is in particle form having an average mesh size from about 20 mesh to about 60 mesh.

Preferably, the amphiphilic compound comprises from about 4 to about 24 carbons, more preferably from about 6 to about 18 carbons. Preferably, the amphiphilic compound is an alkyl silane comprising an alkyl group having four or more linearly connected carbon atoms. Preferably, the amphiphilic compound is an alkyl quaternary ammonium cation or an alkyl silane.

Examples of inorganic molecular sieve substrates include, but are not limited to, the group consisting of zeolite, aluminophosphate, mesoporous silicate, mesoporous aluminosilicate, and mixtures thereof. Preferably, the inorganic molecular sieve substrate is a zeolite selected from the group consisting of zeolite ZSM-5, zeolite A, zeolite X, zeolite Y, zeolite K-G, zeolite ZK-5, zeolite Beta, zeolite ZK-4, and mixtures thereof, and more preferably the zeolite is selected from the group consisting of zeolite A, zeolite ZSM-5, zeolite X, and mixtures thereof.

DETAILED DESCRIPTION OF PREFERRED EMBODIMENTS

Figure 1:
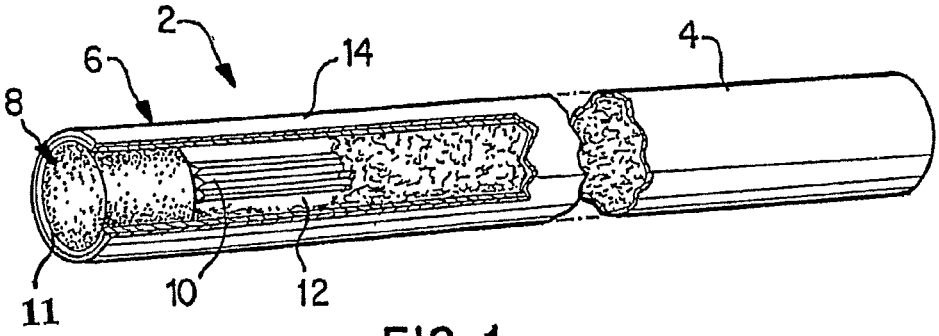
FIG. 1 is a partially broken-away perspective view of a cigarette incorporating one embodiment wherein folded paper containing amphiphile-modified sorbent is inserted into a hollow portion of a tubular filter element of the cigarette.

The amphiphile-modified sorbents described below can be used, for example, in smoking articles for selective removal of one or more selected constituents of mainstream smoke. By "selective removal" is meant that certain constituents are at least partially removed from mainstream smoke, while other constituents are not substantially removed. The term "selective" also encompasses preferential removal of certain constituents from mainstream smoke, i.e. where more than one constituent may be removed, but where one constituent is removed to a greater extent than another constituent.

With reference to a cigarette, the term "mainstream" smoke refers to the mixture of gases passing down the tobacco rod and issuing through the filter end, i.e. the amount of smoke issuing or drawn from the mouth end of a smoking article during smoking.

The term "molecular sieve" as used herein refers to an ordered porous material such as aluminosilicates, which are commonly called zeolites, or aluminophosphates, mesoporous silicates, and related porous materials such as various porous metal oxides, which may comprise further inorganic or organic ions and/or metals. A molecular sieve as used herein further refers to a material having pores with dimensions less than about 500 Å, preferably less than 300 Å, including microporous and mesoporous molecular sieves. The term "microporous molecular sieves" generally refers to such materials having pore sizes of about 20 Å or less, while the term "mesoporous molecular sieves" generally refers to such materials with pore sizes of about 20-500 Å and preferably 20 to 300 Å.

The term "sorption" denotes filtration through absorption and/or adsorption. Sorption is intended to cover interactions on the outer surface of the sorbent, as well as interactions within the pores, such as channels or cavities, of the sorbent. In other words, a sorbent is a substance that has the ability to condense or hold molecules of other substances on its surface, and/or the ability to take up another substance, i.e. through penetration of the other substance into its inner structure or into its pores. The term adsorption also denotes filtration through physical sieving, i.e. capture of certain constituents in the pores of the sorbent. The term "sorbent" as used herein refers to either an adsorbent, an absorbent, or a substance that functions as both an adsorbent and an absorbent.

The terms "amphiphile" and "amphiphilic" as used herein refer to any substance comprising at least both a first portion (usually substantially non-polar) which, if separate from the amphiphile, would have a substantially greater solubility in, or a greater attraction to, an organic solvent, (i.e., acetonitrile, hexane, oil, and the like) than water, and a second portion (usually at least partially polar) which, if separate from the amphiphile, would be soluble in water or, if insoluble, may exist in a substantially hydrated form. The amphiphile itself may or may not be soluble in water or any particular, organic solvent. For example, compounds such as alkyl quaternary ammonium cations are considered amphiphiles because the molecules comprise a more hydrophobic alkyl segment and a more hydrophilic ammonium group. Likewise, an alkyl silane is considered an amphiphile because the molecules comprise a more hydrophobic alkyl segment and a more hydrophilic silane group. In another sense of the term, for example, an amphiphile-modified sorbent is also amphiphilic because the insoluble inorganic substrate particles may commonly be substantially hydrated by themselves while the hydrophobic portions (i.e. alkyl chains) of the amphiphilic coating are more soluble in oil than in water.

With respect to the amphiphile-modified sorbents, a naturally hydrophilic molecular sieve substrate is rendered more hydrophobic by one or more amphiphilic compounds. Preferably, the amphiphile coating can create a more hydrophobic exterior surface of the inorganic molecular sieve substrate without changing the nature of the interior micropores, thus providing multiple selective sorbent functionality. For instance, the surface of the amphiphile-modified sorbent may be rendered capable of retaining organic constituents of smoke, while the internal pores of the inorganic molecular sieve substrate may retain the ability to adsorb constituents of smoke that are smaller than the internal pores.

In one embodiment, the amphiphilic compounds may comprise specific functional groups in order to confer certain desired properties, such as electrostatic charge, ion exchange capacity, and reactive functional groups. Selected constituents of mainstream smoke may be specifically targeted and removed by a combination of molecular sieving, ion exchange, hydrophobic interactions, chelation, and/or covalent binding.

Preferably the amphiphile and sorbed smoke constituents are prevented from entering or re-entering the smoke stream because the amphiphile is either electrostatically or covalently bound to the inorganic molecular sieve substrate. In a preferred embodiment, properties of the amphiphile and inorganic molecular sieve substrate may be varied individually or in combination to target specific classes of gas-phase smoke constituents. For example, the hydrophobicity of the amphiphile may be adjusted to target certain classes of constituents, and/or reactive functional, groups of the amphiphile may be chosen to react with certain classes of constituents. Moreover, the molecular sieve pore sizes may be chosen or modified to match specific constituents, and/or catalytic constituents may be embedded within the molecular sieve to chemically react with specific constituents.

This aspect is advantageous over filter arrangements wherein gaseous constituents are non-selectively absorbed, adsorbed, or otherwise removed from a smoke stream. With an amphiphile coating the external surface of the molecular sieve, the surface chemistry is changed, which can lead to an increased capacity for the absorption of nonpolar organic compounds. Furthermore, the ion exchange capacity of the molecular sieve and the accessibility of polar molecules to the interior spaces of the molecular sieve and to catalytic sites which may be contained therein are maintained. By selecting the properties of the amphiphile, sequestration of specific hydrophobic constituents such as aromatic hydrocarbons may be optimized. By providing a specific functional group to the amphiphile, properties not inherent in inorganic molecular sieves may be incorporated into the filter arrangement. Examples include hydrophobicity, anion exchange, metal chelation, and specific reactivities. A preferred reactivity to aldehydes may be provided, for example, by primary amine groups which can covalently bind aldehydes. Anion exchange capacity may be provided to modified zeolites by positively charged functional substituents of the amphiphile. Metal chelation may be provided by including arrangements of acidic functional groups in a substituted alkyl chain of an amphiphile. For example, metal chelating groups may be covalently incorporated in some or all of the amphiphilic compounds coating the molecular sieve sorbent.

The inorganic molecular sieve substrate may be a zeolite. Zeolites are porous materials predominantly comprised of aluminosilicate. Zeolite pores may be more or less uniform micropores and may have pore dimensions over a range of sizes, e.g., below 20 Å; the material may further comprise additional metals and metal oxides. Synthetic zeolite materials may have more uniform pore dimensions and a more ordered structure. Various zeolite types are described, for example, in U.S. Pat. No. 3,702,886 (zeolite ZSM-5), U.S. Pat. No. 2,882,243 (zeolite A), U.S. Pat. No. 2,882,244 (zeolite X), U.S. Pat. No. 3,130,007 (zeolite Y), U.S. Pat. No. 3,055,654 (zeolite K-G), U.S. Pat. No. 3,247,195 (zeolite ZK-5), U.S. Pat. No. 3,308,069 (zeolite Beta), U.S. Pat. No. 3,314,752 (zeolite ZK-4). A source of natural zeolite in North America is the St. Cloud Mining Company, Truth or Consequences, N. Mex. One preferred characteristic for the zeolites is a well defined pore size. Preferred zeolite molecular sieve substrate materials include A, ZSM-5 and Y-type zeolites, or combinations thereof.

The surface of a preferred zeolite has a permanent negative charge. Therefore, when zeolite is used as the molecular sieve substrate, the amphiphile compounds may be any amphiphile compound possessing a cationic charge. Preferably, the cationic charge is a permanent charge. The interaction of the negatively charged surface and the positively charged amphiphile serves to stably bind the amphiphile to the substrate. The amphiphile may thus be retained on the zeolite surface without substantial loss during washing and processing steps of manufacturing and may be retained on the substrate under the conditions of intended use. Alternatively, silicate groups at the surface of zeolite may be utilized to covalently bind an alkyl silane amphiphile to the surface of a molecular sieve substrate. In this embodiment, the amphiphile is covalently bonded to the molecular sieve throughout processing and intended use and is therefore a preferred embodiment.

The inorganic molecular sieve substrate may be a mesoporous silicate, a mesoporous aluminosilicate, or a silica gel. Mesoporous silicates are described, for example, in patents relating to MCM-41 and MCM-48 and SBA-15; such as U.S. Pat. Nos. 5,098,684, 5,102,643 and 5,108,725, which are all hereby incorporated by reference in their entirety. Silica gel materials and methods for making such materials, are described, for example, in U.S. Pat. Nos. 4,148,864, 5,376,348 and 6,168,773, which are all hereby incorporated by reference in their entirety.

Cationic amphiphiles may be electrostatically bound to a negatively charged molecular sieve such as a zeolite. Cationic amphiphiles exist as ions in solution and the cationic portion of the compound is surface active. Quaternary ammonium compounds may be regarded, as analogous to an ammonium chloride salt molecule in which all four hydrogen atoms are replaced by organic radicals. When one of these replacement radicals is a straight-chain, primary alkyl of about 6-18 carbon atoms chain length and the others are of about 1-3 carbon atoms, then the compound will be reasonably water soluble and surface active. If two or more of the substituent radicals are higher alkyls, then the compound retains its cationic nature but may become water-insoluble. For example, suitable quaternary ammonium cationic alkyl compounds include, but are not limited to, those with the general formula:

$$(CH_3(CH_2)_n)_3—N—R^1; \quad (I)$$

where n=0, 1 or 2, preferably 0;

N is a nitrogen atom;

$R^1$ is an aliphatic, saturated or unsaturated, straight, branched, or cyclic, substituted or unsubstituted chain of 1 to 24 carbons, preferably 6-18 carbons. Optionally, $R^1$ may be substituted, for example, at any number of positions with one or more of —H, —$NH_3$, —OH, —SH, or —COOH. Optionally, $R^1$ may be interrupted, for example, by one or more of —NH—, —CH=CH—, —$CHR^1$—, —$CR^{1'}R^{1''}$—, or —$NR^1$—; where $R^{1'}$ and $R^{1''}$ are alkyl groups such as $R^1$ and may be the same or different. In general, $R^1$ may alternatively be any organic radical including carbohydrate or benzalkyl groups. In a preferred embodiment, $R^1$ is a straight aliphatic chain of about 3-24 carbon atoms, preferably 4-20 carbon atoms, more preferably 6-18 carbon atoms. $R^1$ may be optionally substituted at one or more positions, for example at a terminal position. Substituent groups may be chosen to convey a specific functionality to the amphiphile.

A primary amine group is useful for the specific removal of aldehydes. Carboxyl and/or sulfides may be chosen to chelate metals. A second same or different alkyl chain may replace one of the $(CH_3(CH_2)_n)$— groups. The amphiphile composition may comprise a single species or a mixture of amphiphile compounds. Various aliphatic chain lengths, degree and mode of unsaturation (cis and/or trans), branched and unbranched chains may be combined in mixtures in order to convey a desired spectrum of adsorptivity. Such compounds are widely available from a variety of manufacturers. The amphiphile compounds may be prepared using any suitable method; for example, see March, *Advanced Organic Chemistry* (John Wiley & Sons Inc., 1995); House, *Modern Synthetic Reactions* (Benjamin Cummings, 1972); or U.S. Pat. Nos. 4,982,000; 5,545,749 and the patents referenced therein. The amphiphile may also be any other cationic amphiphile. Acceptable alternatives which are commercially available or which may be made by well known synthetic methods include, for example, imidazolines, ethoxylated amines, and quaternary phospholipids.

In an embodiment, an amphiphile-modified molecular sieve sorbent may be made by combining an amphiphile compound in solution and a zeolite molecular sieve substrate. The amphiphile may be in the form of a chloride salt in aqueous solution. Certain amphiphile compounds such as un-substituted alkyl quaternary ammonium cations can form bilayers on the substrate surface at sufficiently high concentrations. However, the outer-layer may be removed by repeated washing. Amphiphile concentrations below the critical micellar concentration may be used for formation of a monolayer of amphiphile on the exterior of a zeolite. The amphiphile is generally too large to enter the interior channels of a microporous molecular sieve (i.e., having a pore diameter of about 20 Å or less). After a period of time sufficient to allow cation exchange, the amphiphile-modified zeolite material is removed from the solution and may be washed with water. The amphiphile-modified zeolite material may be dried and incorporated into filter arrangements.

A preferred amphiphile-modified sorbent can be prepared as follows: Add about 10 grams of ZSM-5 zeolite powder to about 100 mL of a aqueous solution of cetyltrimethylammonium bromide (10% by weight) followed by stirring at room temperature for about 2 hours. The mixture is then transferred into a Teflon-lined pressure vessel and heated at about 150° C. for about 48 hours. The final solid product is filtered, washed with distilled water, and dried in air about 100° C. for about 12 hours. In this procedure the loading of the amphiphile is controlled by the concentration of the alkyl quaternary ammonium compound in the starting aqueous solution.

In an alternative embodiment, the amphiphile may be an alkyl silane. Examples include alkyl silane compounds such as those with the general formula:

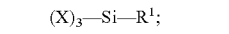

$$(X)_3—Si—R^1; \quad (II)$$

where X may be for example a halogen such as Cl—, HO—, $CH_3O$—, or $CH_3CH_2O$—;

Si is a silicon atom;

$R^1$ is an aliphatic, saturated or unsaturated, straight, branched, or cyclic, substituted or unsubstituted chain of 3 to 24 carbons, preferably 4-20 carbons, more preferably 6-18 carbons. Optionally, $R^1$ may be substituted, for example, at any number of positions with one or more of —H, —$NH_3$, —OH, —SH or —COOH. Optionally, $R^1$ may be interrupted, for example, by one or more of —NH—, —CH=CH—, —$CHR^1$, —$CR^{1'}R^{1''}$— or —$NR^1$—; where $R^{1'}$ and $R^{1''}$ are alkyl groups such as $R^1$ and may be the same or different. In general, $R^1$ may alternatively be any organic radical including carbohydrate or benzalkyl groups. In a preferred embodiment, $R^1$ is a straight aliphatic chain of about 3-24 carbon atoms, preferably 4-20 carbon atoms, more preferably 6-18 carbon atoms. $R^1$ may be optionally substituted at one or more positions, for example at a terminal position. Substituent groups may be chosen to convey a specific functionality to the amphiphile. A primary amine group is useful for the specific removal of aldehydes. Carboxyl and/or sulfides may be chosen to chelate metals. The amphiphile composition may comprise a single species or a mixture of amphiphile compounds. Various aliphatic chain lengths, degree and mode of unsaturation (cis and/or trans), branched and unbranched chains may be combined in mixtures in order to convey a desired spectrum of adsorptivity.

The amphiphile compounds may be prepared using any suitable technique. For routine synthetic methods see for example: March, *Advanced Organic Chemistry* (John Wiley & Sons Inc., 1995) and House, *Modern Synthetic Reactions* (Benjamin Cummings, 1972). In addition, a variety of amphiphilic compounds are commercially available from a variety of manufacturers, such as Dow Corning and Union Carbide.

Thus, in an alternative embodiment, an alkyl silane amphiphile may be covalently bonded to the surface of a molecular sieve substrate material. A zeolite substrate may be prepared by drying at a temperature and pressure sufficient to remove essentially all bound water, for example at 100°-200° C. for 1 or 2 or more hours and optionally under a reduced pressure and/or in an atmosphere of dry inert gas. An alkyl trichlorosilane may be dissolved in methanol which can result in the substitution of three methoxy groups bound to the silicon atom; a resulting alkyl trimethoxysilane may be distilled under conditions sufficient to remove substantially all of the liquid methanol and residual water without decomposing the alkyl methoxysilane composition. An alkyl methoxysilane composition and the molecular sieve may be combined in an organic solvent such as toluene, benzene, xylene, hexanes, cyclo-hexane, alcohols or other well known solvents which may dissolve or suspend the alkyl silane. The organic solvent is preferably anhydrous and capable of dissolving the amphiphile. The suspension of molecular sieve particles such as zeolite and alkyl silane in organic solvent may be stirred and the temperature may be maintained at an elevated temperature sufficient to allow the covalent reaction of the silane with the silica groups of the molecular sieve. The temperature is preferably at or lower than the boiling point of the anhydrous organic solvent. For example, the temperature of the mixture of molecular sieve particles and alkyl silane in organic fluid may be maintained at 100° to 200° C. for 1 to 4 or more hours. The mixture may be maintained in an inert gas atmosphere such as dry nitrogen gas or argon. The amphiphile-modified sorbent may be separated from the solvent for example by filtration or decanting. The amphiphile-modified sorbent may optionally be washed one or more times with one or more solvents such as water or alcohols. The amphiphile-modified sorbent may then be dried at an elevated temperature, for example about 100° C. for 1-8 hours or more.

Another preferred amphiphile-modified sorbent can be prepared as follows: Add about 10 grams of ZSM-5 zeolite powder to a solution containing about 100 mL of dry toluene and about 25 grams of octadecytrimethoxysilane followed by vigorous shaking or stirring at room temperature for about 10 minutes. The suspension is then transferred into a Teflon-lined pressure vessel, sealed and heated at about 100° C. for about 12 hours. The final solid product is filtered, washed with about 100 mL of dry toluene followed by about 500 mL of dichloromethane twice, and dried in air at about 120° C. for about 12 hours. In this procedure for producing an amphiphile-modified sorbent, octadecytrichlorosilane can be used as a substitute for octadecytrimethoxysiliane, and the amount of the silane dissolved in dry toluene can vary depending on the desired loading of amphiphile on the zeolite molecular sieve.

When a molecular sieve substrate is chosen with a pore size larger than the amphiphile molecule as is possible with some mesoporous molecular sieves, such as some mesoporous silicates, the amount of amphiphile associated with the molecular sieve may be greater because the amphiphile may also bind within the molecular sieve. In such an arrangement, the choice of amphiphile may modify the interior of the molecular sieve as well as the exterior and also may modify the effective pore size and may thereby further tailor the adsorption profile of the amphiphile-modified sorbent.

In one embodiment, amphiphile-modified sorbent is incorporated into and/or onto a support such as paper inserted into a hollow portion of the cigarette filter. The support is preferably in the form of a sheet material such as crepe paper, filter paper, or tipping paper. However, other suitable support materials such as organic or inorganic cigarette compatible materials can also be used.

FIG. 1 illustrates a cigarette 2 having a tobacco rod 4, a filter portion 6, and a mouthpiece filter plug 8. As shown, amphiphile-modified sorbent can be loaded onto folded paper 10 inserted into a hollow cavity such as the interior of a free-flow sleeve 12 forming part of the filter portion 6.

Figure 2:
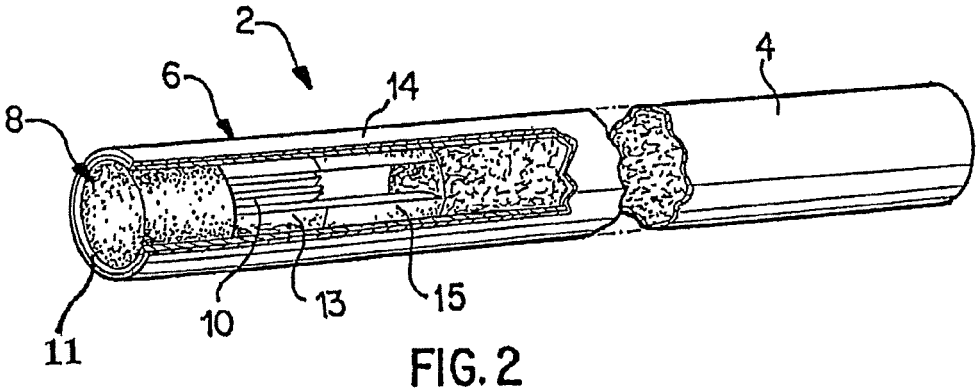
FIG. 2 is partially broken-away perspective view of another embodiment wherein amphiphile-modified sorbent is incorporated in folded paper and inserted into a hollow portion of a first free-flow sleeve of a tubular filter element next to a second free-flow sleeve.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, a desired amount of amphiphile-modified sorbent can be provided in the cigarette filter portion by adjusting the amount of amphiphile-modified sorbent coated per unit area of the paper and/or the total area of coated paper employed in the filter (e.g., higher amounts of amphiphile-modified sorbent can be provided simply by using larger pieces of coated paper). In the cigarettes shown in FIGS. 1 and 2, the tobacco rod 4 and the filter portion 6 are joined together with tipping paper 14. In both cigarettes, the filter portion 6 may be held together by filter overwrap 11.

The amphiphile-modified sorbent can be incorporated into the filter paper in a number of ways. For example, the amphiphile-modified molecular sieve can be mixed with water to form a slurry. The slurry can then be coated onto pre-formed filter paper and allowed to dry. The filter paper can then be incorporated into the filter portion of a cigarette in the manner shown in FIGS. 1 and 2. Alternatively, the dried paper can be wrapped into a plug shape and inserted into a filter portion of the cigarette. For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively, the amphiphile-modified molecular sieve is added to the filter paper during the paper-making process. For example, the amphiphile-modified molecular sieve can be mixed with bulk cellulose to form a cellulose pulp mixture. The mixture can be then formed into filter paper according to methods known in the art.

Figure 3:
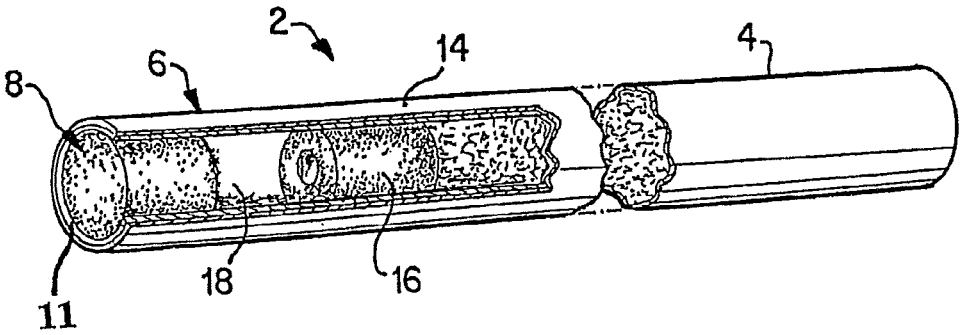
FIG. 3 is a partially broken-away perspective view of another embodiment wherein amphiphile-modified sorbent is incorporated in a plug-space-plug filter element.

In another embodiment, the amphiphile-modified sorbent is incorporated into the fibrous material of the cigarette filter portion itself. Such filter materials include, but are not limited to, fibrous filter materials including paper, cellulose acetate fibers, and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14. The filter portion 6 may a filter overwrap 11. The filter overwrap 11 containing traditional fibrous filter material and amphiphile-modified sorbent can be incorporated in or on the filter overwrap 11 such as by being coated thereon. Alternatively, the amphiphile-modified sorbent can be incorporated in the mouthpiece filter 8, in the plug 16, and/or in the space 18. Moreover, the amphiphile-modified sorbent can be incorporated in any element of the filter portion of a cigarette. For example, the filter portion may consist only of the mouthpiece filter 8 and the amphiphile-modified sorbent can be incorporated in the mouthpiece filter 8.

Figure 4:
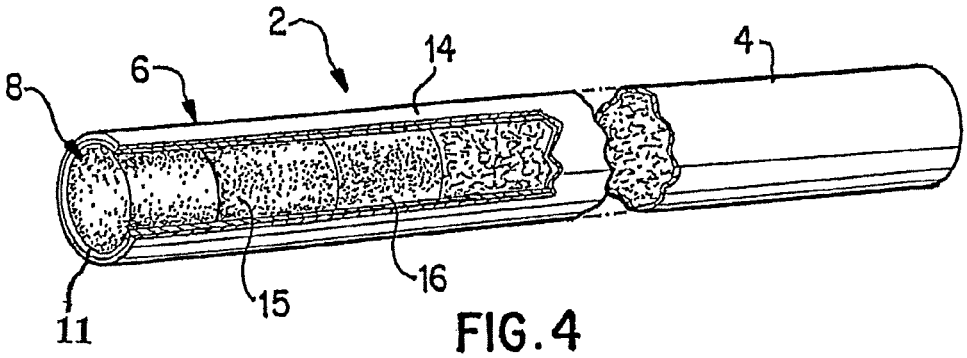
FIG. 4 is a partially broken-away perspective view of another embodiment wherein amphiphile-modified sorbent is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules of amphiphile-modified sorbent or a plug. 15 made of material such as fibrous polypropylene or cellulose acetate containing amphiphile-modified sorbent. As in the previous embodiment, the plug 16 can be hollow or solid and the tobacco rod 4 and filter portion 6 are joined together with tipping paper 14. There is also a filter overwrap 11.

Figure 5:
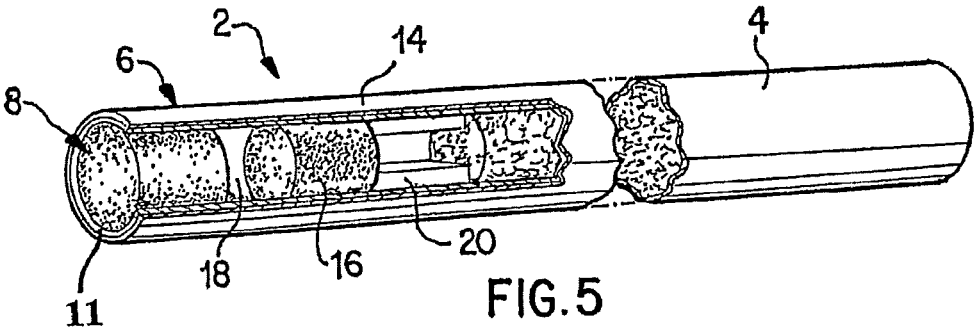
FIG. 5 is a partially broken-away perspective view of another embodiment wherein amphiphile-modified sorbent is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. The amphiphile-modified sorbent can be incorporated into one or more elements of the filter portion 6. For instance, the amphiphile-modified sorbent can be incorporated into the sleeve 20 or granules of the amphiphile-modified sorbent can be filled into the space within the sleeve 20. If desired, the plug 16 and sleeve 20 can be made of material such as fibrous polypropylene or cellulose acetate containing amphiphile-modified sorbent. As in the previous embodiment, the plug 16 can be hollow or solid.

Figure 6:
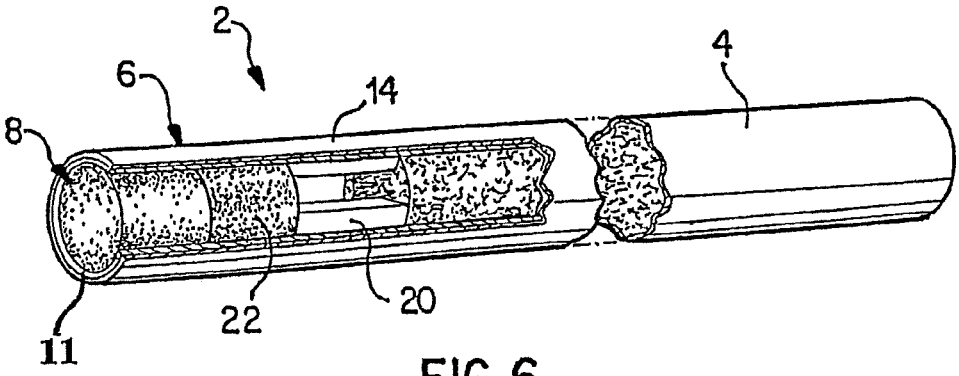
FIG. 6 is a partially broken-away perspective view of another embodiment wherein amphiphile-modified sorbent is incorporated in a three-part filter element having two plugs and a hollow sleeve.
Figure 7:
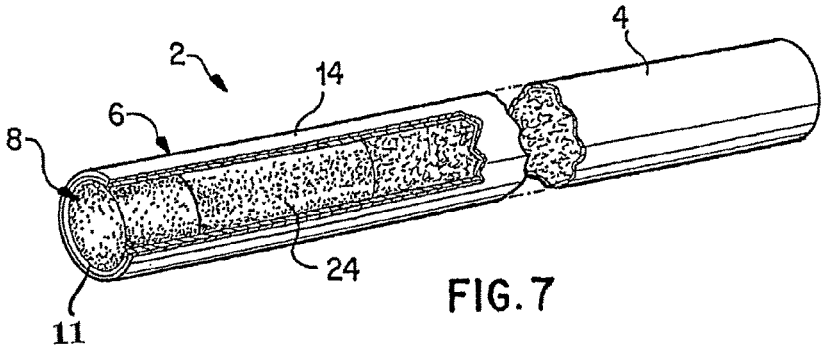
FIG. 7 is a partially broken-away perspective view of another embodiment wherein amphiphile-modified sorbent is incorporated id a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and the amphiphile-modified sorbent can be incorporated in one or more of these filter elements. In FIG. 7, the filter portion 6 includes a mouthpiece filter 8 and a plug 24, and the amphiphile-modified sorbent can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply the amphiphile-modified sorbent to filter fibers or other substrate supports. For example, the amphiphile-modified sorbent can be added to the filter fibers before they are formed into a filter cartridge, e.g., a tip for a cigarette. The amphiphile-modified sorbent can be added to the filter fibers, for example, in the form of a dry powder or a slurry. If the amphiphile-modified sorbent is applied in the form of a slurry, the fibers are allowed to dry before they are formed into a filter cartridge.

In another preferred embodiment, the amphiphile-modified sorbent is employed in a hollow portion of a cigarette filter. For example, some cigarette filters have a plug/space/plug configuration in which the plugs comprise a fibrous filter material and the space is simply a void between the two filter plugs. That void can be filled with the amphiphile-modified sorbent. An example of this embodiment is shown in FIG. 3. The amphiphile-modified sorbent can be in granular form or can be loaded onto a suitable support such as a fiber or thread.

Figure 8:
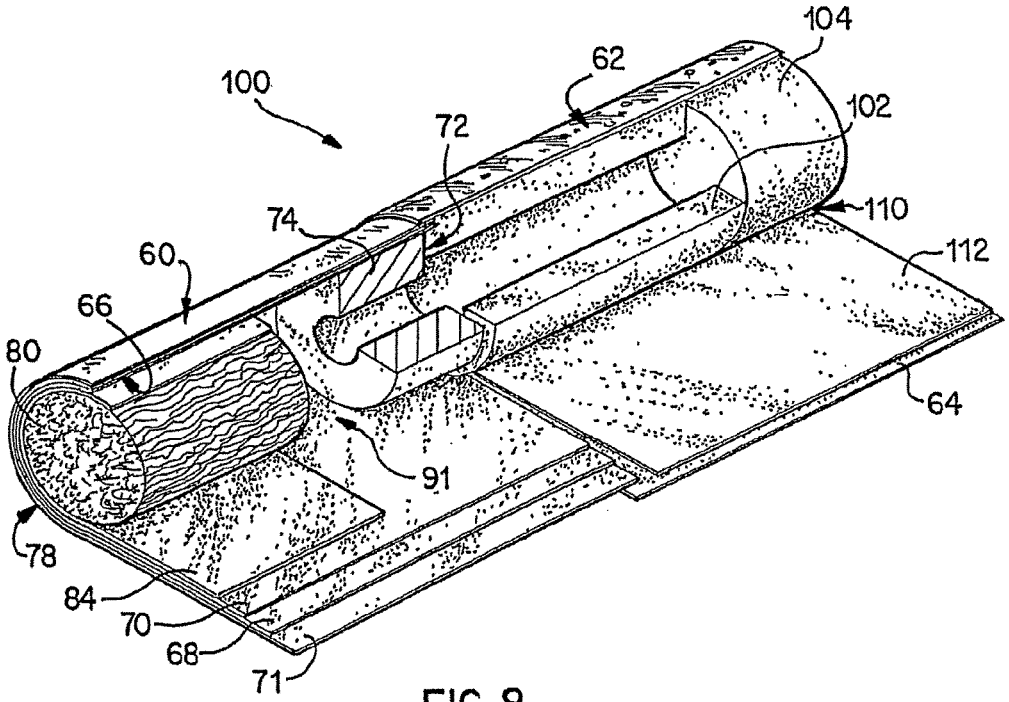
FIG. 8 is a partially broken-away perspective view of another embodiment wherein amphiphile-modified sorbent is incorporated in a filter element which may be used in a smoking article.

In another embodiment, the amphiphile-modified sorbent is employed in a filter portion of a cigarette for use with a smoking device as described in U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating the amphiphile-modified sorbent.

In such a cigarette, amphiphile-modified sorbent can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, the amphiphile-modified sorbent can be incorporated into the fibrous wall portions of the tubular free-flow filter element 102 itself. For instance, the tubular free-flow filter element or sleeve 102 can be made of suitable materials such as polypropylene or cellulose acetate fibers and the amphiphile-modified sorbent can be mixed with such fibers prior to or as part of the sleeve forming process.

In another embodiment, the amphiphile-modified sorbent can be incorporated into the mouthpiece filter plug 104 instead of in the element 102. However, as in the previously described embodiments, amphiphile-modified sorbent may be incorporated into more than one constituent of a filter portion such as by being incorporated into the mouthpiece filter plug 104 and into the tubular free-flow filter element 102.

The filter portion 62 of FIG. 8 can also be modified to create a void space into which the amphiphile-modified sorbent can be inserted.

As explained above, amphiphile-modified sorbent can be incorporated in various support materials. When the amphiphile-modified sorbent is used in filter paper, the particles may have an average particle diameter of up to 100 μm, preferably 2 to 50 μm. When the amphiphile-modified sorbent is used in filter fibers or other mechanical supports, larger particles may be used. Such particles preferably have a mesh size from 20 to 60, and more preferably from 35 to 60 mesh.

The amount of amphiphile-modified sorbent employed in the cigarette filter by way of incorporation on a suitable support such as filter paper and/or filter fibers depends on the amount of constituents in the tobacco smoke and the amount of constituents desired to be removed. As an example, the filter paper and the filter fibers may contain, from 10% to 50% by weight of the amphiphile-modified sorbent.

Another embodiment relates to methods of making a filter. The methods comprise incorporating an amphiphile-modified sorbent having at least one amphiphilic compound bound to an inorganic molecular sieve substrate into a cigarette filter.

Most filters contain four main constituents: filter tow, plasticizer, plug wrap and adhesive. Often the filter tow comprises a bundle of cellulose acetate fibers or papers that are bound together using the plasticizer, which acts as a hardening agent. The filter is contained in the plug wrap, usually a paper wrapper, which is secured using an adhesive. Any conventional or modified method of making cigarette filters may be used to incorporate the amphiphile-modified sorbent.

Another embodiment relates to methods of making cigarettes. In one embodiment, the method comprises: (i) providing a cut filler to a cigarette making machine to form a tobacco column; (ii) placing a paper wrapper around the tobacco column to form a tobacco rod; and (iii) attaching a cigarette filter incorporating an amphiphile-modified sorbent to the tobacco rod to form the cigarette.

Examples of suitable types of tobacco materials which may be used include flue-cured, Burley, Maryland or Oriental tobaccos, the rare or specialty tobaccos, and blends thereof. The tobacco material can be provided in, the form of tobacco lamina; processed tobacco materials such as volume expanded or puffed tobacco, processed tobacco stems such as cut-rolled or cut-puffed stems, reconstituted tobacco materials; or blends thereof. Tobacco substitutes may also be used.

In cigarette manufacture, the tobacco is normally employed in the forth of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

Cigarettes can be manufactured to any desired specification using standard or modified cigarette making techniques and equipment. The cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

Yet another embodiment relates to methods of smoking the cigarette described above, which involve lighting the cigarette to form smoke and drawing the smoke through the cigarette, wherein during the smoking of the cigarette, the amphiphile-modified sorbent is capable of selectively adsorbing one or more selected constituents from mainstream smoke. Preferably at least 10%, 20%, 30%, 40%, 50% or more of the selected constituent is removed from the tobacco smoke by the sorbent.

"Smoking" of a cigarette means the heating or combustion of the cigarette to form smoke, which can be drawn in through the cigarette. Generally, smoking of a cigarette involves lighting one end of the cigarette and drawing the smoke through the mouth end of the cigarette, while the tobacco contained therein undergoes a combustion reaction. However, the cigarette may also be smoked by other means. For example, the cigarette may be smoked by heating the cigarette and/or heating using an electrical heater, as described in commonly-assigned U.S. Pat. Nos. 6,026,820; 5,988,176; 5,915,387; 5,692,526; 5,692,525; 5,666,976; and 5,499,636, for example.

While the invention has been described in detail with reference to preferred embodiments thereof, it will be apparent to one skilled in the art that various changes can be made, and equivalents employed, without departing from the scope of the invention.

All of the above-mentioned references are herein incorporated by reference in their entirety to the same extent as if each individual reference was specifically and individually indicated to be incorporated herein by reference in its entirety.

What is claimed is:

1. A smoking article comprising an amphiphile-modified sorbent having at least one amphiphilic compound selected from the group consisting of an imidazoline, an ethoxylated amine, and a quaternary phospholipid bound to an inorganic molecular sieve substrate.

2. The smoking article of claim 1, wherein: (a) the smoking article is selected from the group consisting of a cigarette, a pipe, a cigar and a non-traditional cigarette; (b) the amphiphile-modified sorbent is located in a filter; (c) the amphiphile-modified sorbent is capable of removing at least some of at least one selected constituent of mainstream smoke by molecular sieving, ion exchange, hydrophobic interactions, chelation, chemical binding, or combinations thereof; (d) the amphiphile-modified sorbent selectively removes at least some of at least one selected constituent of mainstream smoke; (e) the amphiphile-modified sorbent is capable of removing at least some of a hydrocarbon compound constituent of mainstream smoke or a polar organic compound constituent of mainstream smoke; (f) the amphiphile-modified sorbent is capable of removing at least some of an organic compound constituent of mainstream smoke; (g) the amphiphile-modified sorbent is capable of removing at least one selected constituent of mainstream smoke selected from the group consisting of aldehyde, carbon monoxide, 1,3-butadiene, isoprene, acrolein, acrylonitrile, hydrogen cyanide, o-toluidine, 2 naphtylamine, nitrogen oxide, benzene, N-nitrosonornicotine, phenol, catechol, benz(a)anthracene, and benzo(a)pyrene; (h) the amphiphile-modified sorbent is capable of removing at least some of an aldehyde constituent of mainstream smoke; (i) the amphiphilic compound comprises from about 4 to about 24 carbon; or (j) the amphiphilic compound comprises from about 6 to about 18 carbons.

3. The smoking article of claim 2, wherein the smoking article is a cigarette.

4. The smoking article of claim 2, wherein the filter is a mono filter, a dual filter, a triple filter, a cavity filter, a recessed filter or a free-flow filter.

5. The smoking article of claim 1, wherein: (a) the inorganic molecular sieve substrate is selected from the group consisting of zeolite, aluminophosphate, silicate, aluminosilicates, and mixtures thereof; (b) the inorganic molecular sieve substrate is a zeolite selected from the group consisting of zeolite ZSM-5, zeolite A, zeolite X, zeolite Y, zeolite K-G, zeolite ZK-5, zeolite Beta, zeolite ZK-4, and mixtures thereof; (c) the amphiphilic compound is covalently bound to the surface of the inorganic molecular sieve substrate; (d) the amphiphilic compound is electrostatically bound to the surface of the inorganic molecular sieve substrate; (e) the amphiphile-modified sorbent is in particle form having an average mesh size from about 20 mesh to about 60 mesh; (f) the smoking article is a cigarette including from about 50 mg to about 300 mg of the amphiphile-modified sorbent; (g) the smoking article is a cigarette including from about 100 mg to about 200 mg of the amphiphile-modified sorbent; or (h) the molecular sieve comprises a mesoporous molecular sieve.

6. A cigarette filter comprising an amphiphile-modified sorbent having at least one amphiphilic compound, selected from the group consisting of an imidazoline, an ethoxylated amine, and a quaternary phospholipid bound to an inorganic molecular sieve substrate.

7. The cigarette filter of claim 6, wherein: (a) the amphiphile-modified sorbent is capable of removing at least some of at least one selected constituent of mainstream smoke by molecular sieving, ion exchange, hydrophobic interactions, chelation, chemical binding, or combinations thereof; (b) the amphiphile-modified sorbent selectively removes at least some of at least one selected constituent of mainstream smoke; (c) the amphiphile-modified sorbent is capable of removing at least some of a hydrocarbon compound constituent of mainstream smoke, or a polar organic compound constituent of mainstream smoke; (d) the amphiphile-modified sorbent is capable of removing at least some of an organic compound constituent of mainstream smoke; (e) the amphiphile-modified sorbent is capable of removing at least one selected constituent of mainstream smoke selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, and benzo(a)pyrene; (f) the amphiphile-modified sorbent is capable of removing at least some of an aldehyde constituent of mainstream smoke; (g) the amphiphilic compound comprises from about 4 to about 24 carbons; or (h) the amphiphilic compound comprises from about 6 to about 18 carbons.

8. The cigarette filter of claim 6, wherein: (a) the inorganic molecular sieve substrate is selected from the group consisting of zeolite, aluminophosphate, silicate, aluminosilicates, and mixtures thereof; (b) the inorganic molecular sieve substrate is a zeolite selected from the group consisting of zeolite ZSM-5, zeolite A, zeolite X, zeolite Y, zeolite K-G, zeolite ZK-5, zeolite Beta, zeolite ZK-4, and mixtures thereof; (c) the amphiphilic compound is covalently bound to the surface of the inorganic molecular sieve substrate; (d) the amphiphilic compound is electrostatically bound to the surface of the inorganic molecular sieve substrate; or (e) the amphiphile-modified sorbent is in particle form having an average mesh size from about 20 mesh to about 60 mesh.

9. The cigarette filter of claim 6, wherein: (a) the smoking article is a cigarette including from about 50 mg to about 300 mg of the amphiphile-modified sorbent; (b) the smoking article is a cigarette including from about 100 mg to about 200 mg of the amphiphile-modified sorbent; (c) the filter is selected from the group consisting of a mono filter, a dual filter, a triple filter, a cavity filter, a recessed filter, and a free-flow filter; (d) the filter comprises at least one material selected from the group consisting of cellulose acetate tow, cellulose paper, mono cellulose, mono acetate, and combinations thereof; (e) the amphiphile-modified sorbent is incorporated into one or more cigarette filter parts selected from the group consisting of shaped paper insert, a plug, a space, cigarette filter paper, and a free-flow sleeve; (f) the amphiphile-modified sorbent is incorporated with cellulose acetate fibers forming a plug or a free-flow filter element; (g) the amphiphile-modified sorbent is incorporated with polypropylene fibers forming a plug or free-flow filter element; (h) the amphiphile-modified sorbent is incorporated in at least one of a mouthpiece filter plug, a first tubular filter element adjacent to the mouthpiece filter plug, and a second tubular filter element adjacent to the first tubular element; or (i) the amphiphile-modified sorbent is incorporated in at least one part of a three-piece filter including a mouthpiece filter plug, a first filter plug adjacent to the mouthpiece filter plug, and a second filter plug adjacent to the first filter plug.

10. A method of making a cigarette filter, the method comprising incorporating an amphiphile-modified sorbent having at least one amphiphilic compound, selected from the group consisting of an imidazoline, an ethoxylated amine and a quaternary phospholipid bound to an inorganic molecular sieve substrate into a cigarette filter.

11. The method of claim 10, wherein the filter is a mono filter, a dual filter, a triple filter, a cavity filter, a recessed filter or a free-flow filter.

12. A method of making a cigarette, the method comprising:

(i) providing a cut filler to a cigarette making machine to form a tobacco column;

(ii) placing a paper wrapper around the tobacco column to form a tobacco rod;

(iii) providing a cigarette filter comprising an amphiphile-modified sorbent having at least one amphiphilic compound, selected from the group consisting of an imidazoline, an ethoxylated amine and a quaternary phospholipid bound to an inorganic molecular sieve substrate; and (iv) attaching the cigarette filter to the tobacco rod to form the cigarette.

13. A method of smoking a cigarette comprising an amphiphile-modified sorbent having at least one amphiphilic compound, selected from the group consisting of an imidazoline, an ethoxylated amine and a quaternary phospholipid comprising lighting the cigarette to form smoke and drawing the smoke through the cigarette, wherein during the smoking of the cigarette, the amphiphile-modified sorbent removes at least one selected constituent from mainstream smoke.

14. The method of claim 13, wherein at least one selected constituent of mainstream smoke is removed by molecular sieving, ion exchange, hydrophobic interactions, chelation, chemical binding, or combinations thereof.

15. The method of claim 13, wherein the amphiphile-modified sorbent selectively removes at least some of an organic compound constituent of mainstream smoke.

16. The method according to claim 13, wherein the amphiphile-modified sorbent removes at least some of an aldehyde constituent of mainstream smoke.

* * * * *